US006859954B2

(12) United States Patent
Collins et al.

(10) Patent No.: US 6,859,954 B2
(45) Date of Patent: Mar. 1, 2005

(54) ALCOVE WHIRLPOOL SEAT SPA SYSTEM

(75) Inventors: Sam Collins, Dallas, OR (US); Loren Brooks, Independence, OR (US); Corey Warner, Dallas, OR (US)

(73) Assignee: Marquis Corp., Independence, OR (US)

( * ) Notice: Subject to any disclaimer, the term of this patent is extended or adjusted under 35 U.S.C. 154(b) by 0 days.

(21) Appl. No.: 10/646,057

(22) Filed: Aug. 22, 2003

(65) Prior Publication Data

US 2004/0034919 A1 Feb. 26, 2004

Related U.S. Application Data

(63) Continuation of application No. 10/035,502, filed on Oct. 25, 2001, now Pat. No. 6,611,969.

(60) Provisional application No. 60/243,424, filed on Oct. 25, 2000.

(51) Int. Cl.[7] ..... A47K 3/00; A61H 33/00

(52) U.S. Cl. ..... 4/541.1

(58) Field of Search ..... 600/547, 587, 600/383, 366; 700/279; 702/158; 707/323, 108, 328; 607/5–8, 28, 63; 604/114; 606/41

(56) References Cited

U.S. PATENT DOCUMENTS

| | | | |
|---|---|---|---|
| 3,040,335 | A | 6/1962 | Gellman |
| D259,510 | S | 6/1981 | Reineman |
| D275,597 | S | 9/1984 | Lax |

(List continued on next page.)

OTHER PUBLICATIONS

Freedom Spas, "Freedom from Stress Freedom from Pain" brochure, At least as early as Sep. 10, 2002.
ThermoSpas, "Designer Series" brochure, At least as early as Sep. 10, 2002.
ThermoSpas, "Wholesale Pricing–Designer Series" price list, At least as early as Sep. 10, 2002 (with Aug. 1, 1993 effective date listed thereon).
Dimension One Spas Brochure, at least as early as Oct., 2000.
Down East Spas Brochure "Relax in Stylish Comfort," at least as early as Oct., 2000.
Watkins Manufacturing Corporation, Caldera Spas Brochure, "Relax, Recharge and Reconnect," at least as early as Oct., 2000.
L.A. Spas Brochure, at least as early as Oct., 2000.
Watkins Manufacturing Corporation, Hot Spring Spas Brochure, "Relaxation Has Found Its Ultimate Expression," at least as early as Oct., 2000.
Dimension One Spas, Dimension One Spas Brochure, at least as early as Oct., 2000.
Dimension One Spas, "@Home Hot Tubs" Brochure, at least as early as Oct., 2000.
Watkins Manufacturing Corporation, Tiger River Spas Brochure, at least as early as Oct., 2000.
Watkins Manufacturing Corporation, Solana "Serenity made simple" Brochure, at least as early as Oct., 2000.
Master Spas Brochure, "Jet Away," at least as early as Mar. 1, 2003, 5 pages (including an enlarged view of the LSX spa), Master Spas, Fort Wayne, IN.

*Primary Examiner*—Charles E. Phillips
(74) *Attorney, Agent, or Firm*—Karen Dana Oster

(57) ABSTRACT

An alcove whirlpool seat of the present invention includes a seat member, a seat back, and arm portions on opposite sides of the seat back. The seat back and at least part of the arm portions substantially define a whirlpool area and the arm portions define an open span through which the legs of a user extend when he is seated in the alcove whirlpool seat. At least one jet nozzle is used to direct a stream within the whirlpool area. The at least one jet nozzle, the seat back, and the arm portions together create a whirlpool within the whirlpool area. Exemplary alcove whirlpool seats may be an angled-arm embodiment or a horseshoe embodiment. An alcove whirlpool seat spa system has an interior spa area. One or more whirlpool areas are defined by one or more alcove whirlpool seats within the interior spa area. Within the interior spa area (and outside the whirlpool area) is a spa water flow. The whirlpool flow within the whirlpool area is substantially separate from spa water flow.

16 Claims, 6 Drawing Sheets

U.S. PATENT DOCUMENTS

| | | | |
|---|---|---|---|
| D277,985 | S | 3/1985 | Kingsley |
| D294,863 | S | 3/1988 | Kingsley |
| 4,780,916 | A | 11/1988 | Sutton |
| D301,374 | S | 5/1989 | D'Innocente |
| D305,061 | S | 12/1989 | Pauls et al. |
| D310,566 | S | 9/1990 | Jacuzzi |
| 4,953,240 | A | 9/1990 | Gardenier |
| D318,908 | S | 8/1991 | Reid |
| D319,094 | S | 8/1991 | Richmond |
| D321,555 | S | 11/1991 | Dannenberg |
| 5,172,433 | A | 12/1992 | Lake |
| D333,699 | S | 3/1993 | Jacuzzi et al. |
| 5,228,148 | A | 7/1993 | Weir |
| 5,333,322 | A | 8/1994 | Weir |
| 5,682,625 | A | 11/1997 | Leaverton et al. |
| 5,682,626 | A | 11/1997 | Banks, Jr. et al. |
| D393,056 | S | 3/1998 | Kolada |
| D395,075 | S | 6/1998 | Kolada |
| D405,182 | S | 2/1999 | Larsen |
| D405,185 | S | 2/1999 | Larsen |
| D405,186 | S | 2/1999 | Larsen |
| D431,297 | S | 9/2000 | Larsen et al. |
| D433,510 | S | 11/2000 | Jacuzzi |
| D436,178 | S | 1/2001 | Larsen et al. |
| D445,904 | S | 7/2001 | Larsen |
| D446,309 | S | 8/2001 | Bower |
| D446,310 | S | 8/2001 | Bower |
| D446,862 | S | 8/2001 | Larsen et al. |

ALCOVE WHIRLPOOL SEAT SPA SYSTEM

The present application is a nonprovisional of U.S. Provisional Patent Application Ser. No. 60/243,424, filed Oct. 25, 2000, and a continuation of U.S. patent application Ser. No. 10/035,502 filed Oct. 25, 2001 now U.S. Pat. No. 6,611,969. The present application is based on and claims priority from these applications, the disclosures of which are hereby incorporated herein by reference.

BACKGROUND OF INVENTION

This invention is directed to spa systems, and more specifically, to an alcove whirlpool seat or seats in a spa system that circulates water like a whirlpool.

People have been soaking in hot water for ages, and it is common knowledge that soaking in hot water is therapeutic, relaxing, romantic, and often an enjoyable social experience. The ancient Romans for example, had huge aquatic recreational areas in which hundreds of citizens soaked in hot water and socialized. In Japan, it has been a long-standing family tradition for the family to soak in wooden tubs called "ofuros." And throughout the world, people enjoy soaking in natural hot springs where hot water bubbles from the earth itself. For the most part, soaking has been done in the company of more than one individual. It was the creation of spa systems, hot tubs, spas, individual bathtubs, and equivalent structures such as the JACUZZI® (collectively, "spa systems"), however, that turned the pastime of soaking in hot water into an individualized or private luxury.

Some spa systems use still water, relying primarily on the temperature of the water or minerals within the water to provide the therapeutic benefits.

Many spa systems, however, agitate the water. Sometimes the agitation simulates the bubbles rising from a natural hot spring. More often, the agitation is provided by a stream of water alone, a stream of air alone, or a stream of air/water mixture directed into the water that fills the spa system. This stream is generally created by jet nozzles (or other water and/or air ejectors discussed below) or equivalent structure. A term generally used to describe this type of agitation is "whirlpool agitation."

In some cases, whirlpool agitation refers to the type of agitation in which the stream is directed toward the center of the water filling the spa system. In other cases the stream is directed straight out from the wall of the spa system and is therefore not directed directly toward the center of the water that fills the spa system. In still other cases, the streams are at least partially adjustable and may therefore be directed at various different angles.

Whirlpool agitation can also refer to the type of agitation in which a stream is directed toward a body part for therapeutic purposes. Directing a stream toward a body part is generally considered to have a therapeutic benefit on body parts such as the back or neck. This type of therapy, often referred to as "focused therapy," relaxes the muscles that are directly in front of the jet nozzle. Exemplary references that disclose this type of whirlpool agitation include U.S. Design Pat. No. 294,863 to Kingsley, U.S. Design Pat. Nos. 359,113 and 362,049 to Remo Jacuzzi, and U.S. Design Pat. No. 305,061 to Pauls et al. Another exemplary reference that shows the use of directing a stream to a body part is U.S. Pat. No. 5,682,625 to Leaverton (the "Leaverton reference") which discloses an adjustable head rest for use in a spa system. The adjustable headrest disclosed in the Leaverton reference includes a series of jets that are moved along with the headrest in one unit. These jets eject a concentrated jet stream onto the head, neck, or shoulders of a user.

Within some spa systems, jet nozzles provide streams that create the water agitation. Specifically, jet nozzles can be used to direct a stream of water, air, or an air/water mixture into the body of water enclosed in the spa system. One exemplary jet nozzle (as shown in FIG. 8) is the jet nozzle shown and described in U.S. patent application Ser. No. 29/149,139, which is assigned to the assignee of the present application and incorporated herein by reference.

Although spa systems now come in a variety of shapes and sizes, most known spa systems generally have a single peripheral bench with perhaps a set of steps that interrupt the bench. Only recently have spa systems begun to offer specialized seating such as the lounge shown in U.S. Pat. No. 4,953,240 to Gardenier or the individual chair shown in U.S. Design Pat. No. 259,510 to Reineman. Use of a jet nozzle in one area of the older or the newer spa systems sends ripples and other forms of water agitation throughout the spa system.

BRIEF SUMMARY OF THE INVENTION

The term "whirlpool" has many different definitions. As set forth above, a whirlpool can be defined as a spa system having jet streams that can be directed toward the center of a spa system or toward a body part, as for therapeutic purposes. A whirlpool is also defined as a rapidly rotating current of water. It is this type of whirlpool that the present invention seeks to emulate by rotating water in a substantially circular or oval fashion.

An alcove whirlpool seat of the present invention generally includes a seat member having a circumference with a seat back having integral or attached arm portions on opposite sides of the seat back). The seat back and at least part of the arm portions substantially define a whirlpool area and the arm portions define an open span through which the legs of a user extend when he is seated in the alcove whirlpool seat. At least one jet nozzle is used to direct a stream within the whirlpool area. The at least one jet nozzle, the seat back, and the arm portions together create a whirlpool within the whirlpool area. Exemplary alcove whirlpool seats may be an angled-arm embodiment or a horseshoe embodiment.

An alcove whirlpool seat spa system of the present invention has an interior spa area. One or more whirlpool areas are defined by one or more alcove whirlpool seats within the interior spa area. Within the interior spa area (and outside the whirlpool area) is a spa water flow. The whirlpool flow within the whirlpool area is substantially separate from spa water flow.

The foregoing and other objectives, features, and advantages of the invention will be more readily understood upon consideration of the following detailed description of the invention, taken in conjunction with the accompanying drawings.

DETAILED DESCRIPTION OF THE INVENTION

The present invention is directed to an alcove whirlpool seat spa system. For purposes of this invention, the whirlpool is a rotating current of water, which preferably provides a type of passive therapy to the human body. In contrast with focused therapy, which provides pressure point therapy to the human body by specifically placed jet nozzles that shoot air, water, or an air/water mixture directly onto pressure points on the human skin, the whirlpool of the alcove whirlpool seat employs passive therapy. In passive therapy, water is swirled gently around the person sitting in the alcove seat, thereby providing relaxed therapy to the human body.

The alcove whirlpool seat of the present invention is designed to create an area of containment within a complete spa system. A whirlpool may then be created within the alcove whirlpool seat using at least one jet nozzle 36.

Figure 1:
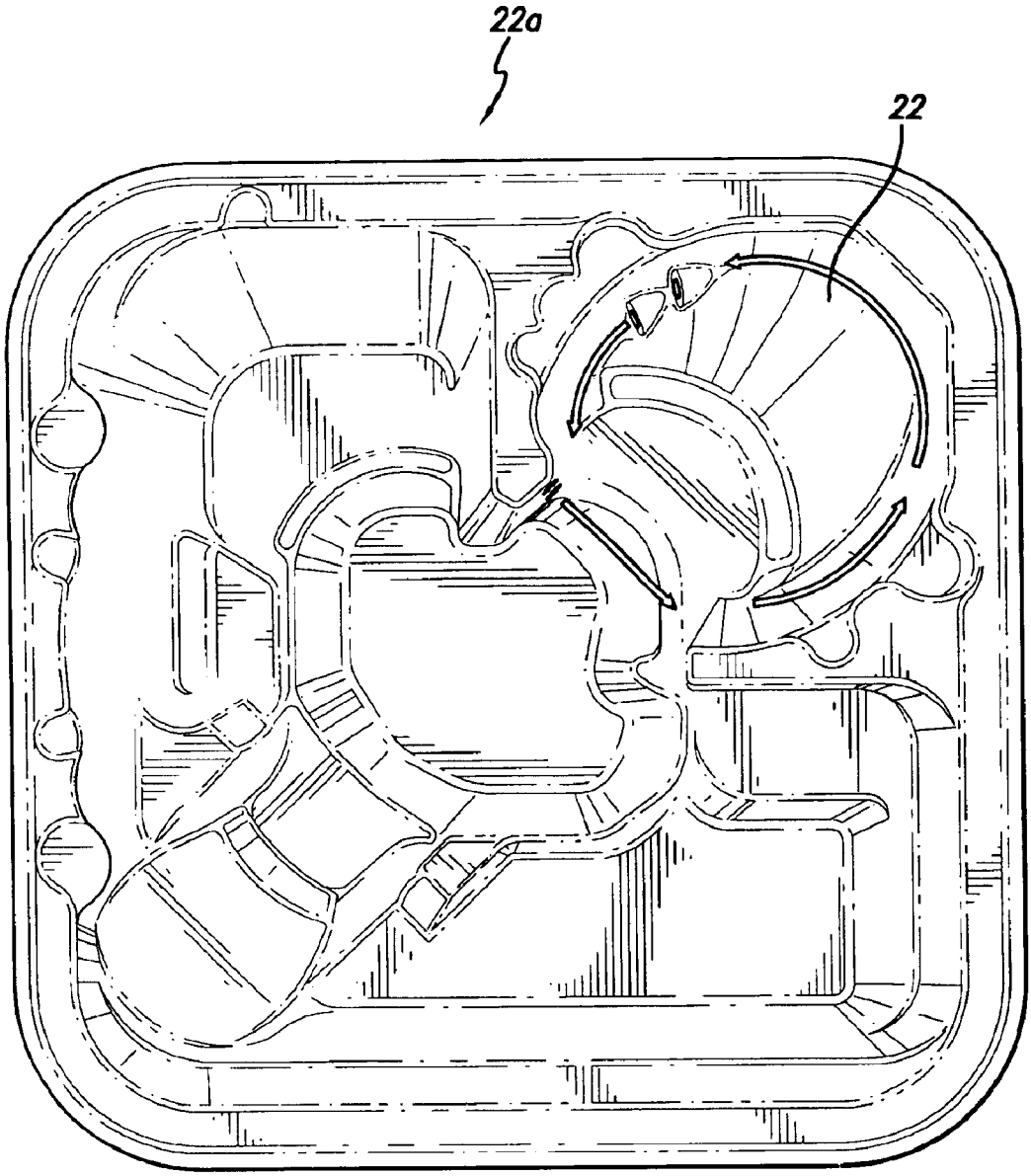
FIG. 1 is a top plan view of a first preferred embodiment of an alcove whirlpool seat spa system of the present invention in which one seat of a multiperson spa system is an alcove whirlpool seat of the present invention.
Figure 2:
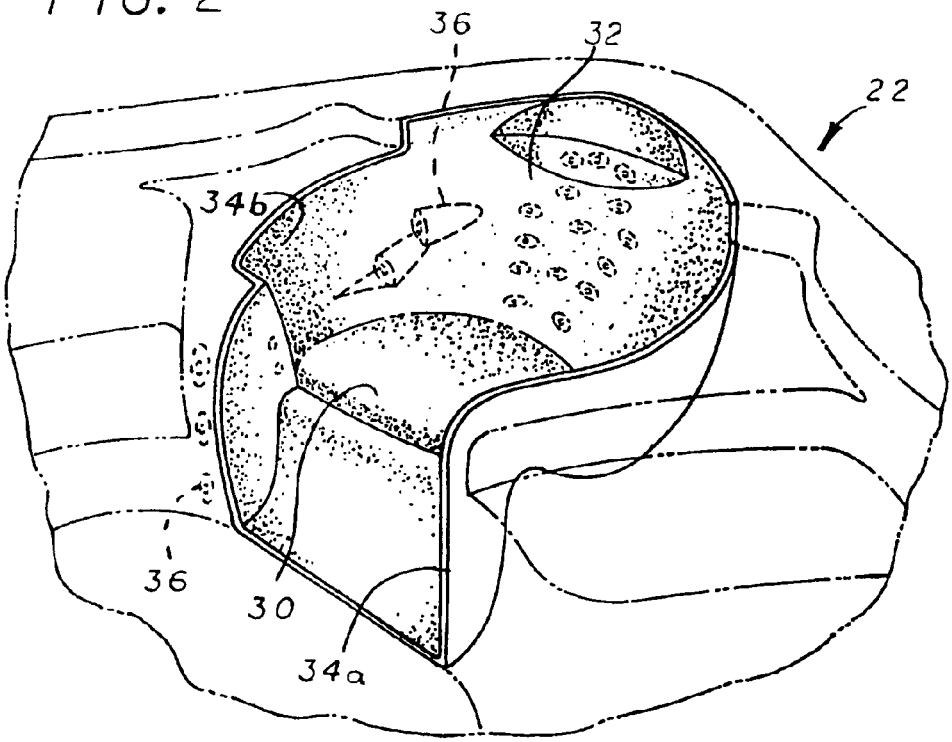
FIG. 2 is an isometric perspective view of a first preferred embodiment of an alcove whirlpool seat (an "angled-arm seat"), which is shown in FIG. 1.
Figure 3:
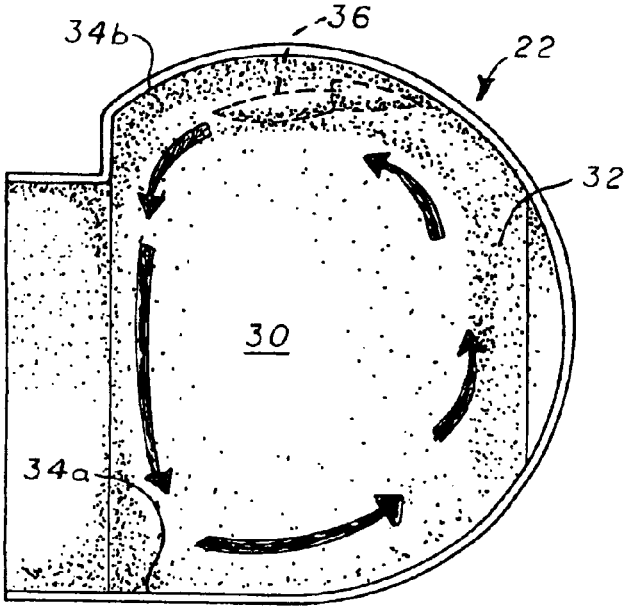
FIG. 3 is a top plan view of the angled-arm seat of FIG. 2.
Figure 4:
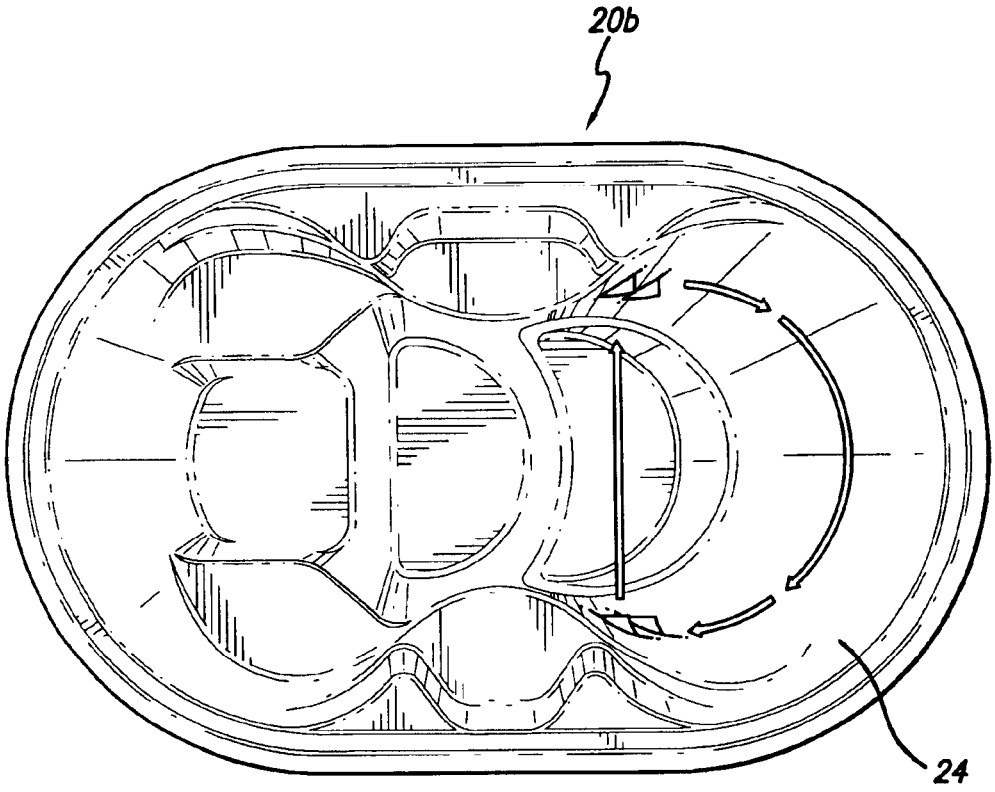
FIG. 4 is a top plan view of a second preferred embodiment of an alcove whirlpool seat spa system of the present invention in which one or more whirlpool seats of a multiperson spa system is an alcove whirlpool seat of the present invention.
Figure 5:
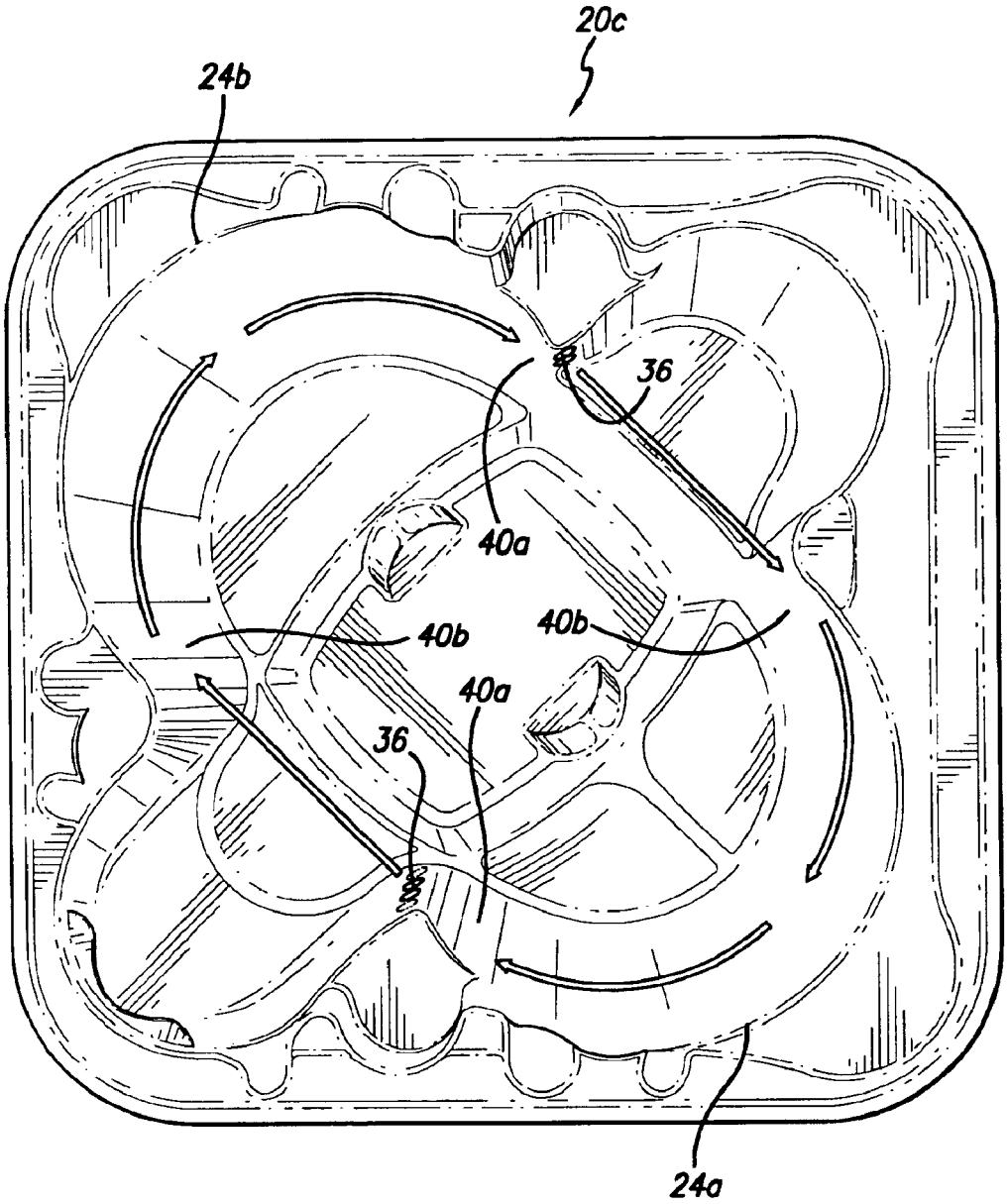
FIG. 5 is a top plan view of a third preferred embodiment of an alcove whirlpool seat spa system of the present invention in which a whirlpool is formed between a plurality of cooperative alcove whirlpool seats of the present invention.
Figure 6:
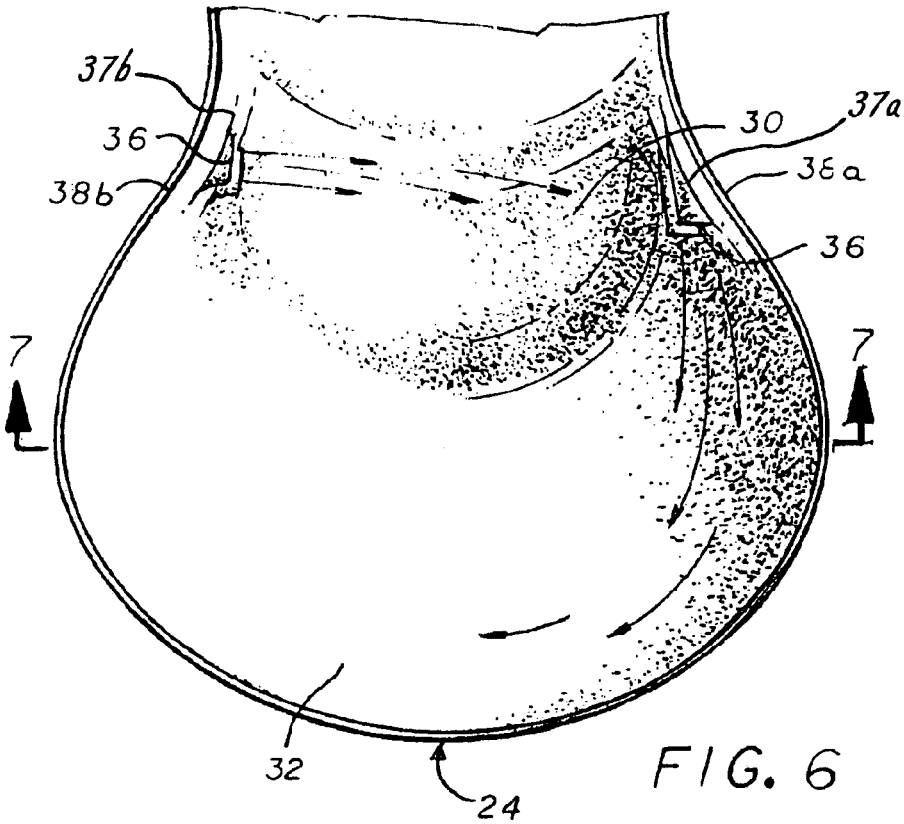
FIG. 6 is a top plan view of a second preferred embodiment of an alcove whirlpool seat (a "horseshoe seat"), which is shown in FIG. 5.
Figure 7:
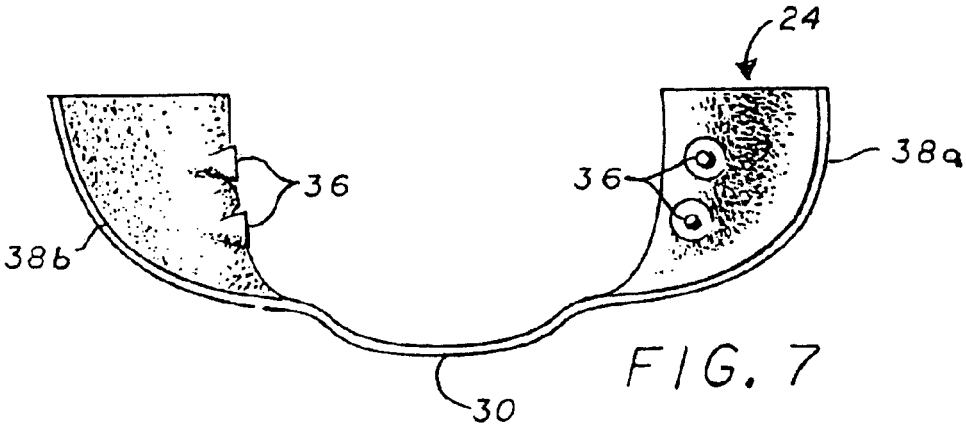
FIG. 7 is a sectional view of the horseshoe seat of FIG. 6.

FIG. 1 shows a first preferred embodiment of an alcove whirlpool seat spa system 20*a* of the present invention in which one seat of a multiperson spa system is an alcove whirlpool seat of the present invention. FIGS. 2 and 3 detail a first preferred embodiment of an alcove whirlpool seat (an "angled-arm seat") 22, which is shown in FIG. 1. FIG. 4 shows a second preferred embodiment of an alcove whirlpool seat spa system 20*b* of the present invention in which one or more whirlpool seats of a multiperson spa system is an alcove whirlpool seat of the present invention. FIG. 5 shows a third preferred embodiment of an alcove whirlpool seat spa system 20*c* of the present invention in which a whirlpool is formed between a plurality of cooperative alcove whirlpool seats of the present invention. FIGS. 6 and 7 detail a second preferred embodiment of an alcove whirlpool seat (a "horseshoe seat") 24, which is shown in FIG. 5.

Alcove Whirlpool Seats

As set forth above, the alcove whirlpool seat of the present invention is designed to create an area of containment within a complete spa system. A whirlpool may then be created within the alcove whirlpool seat using at least one jet nozzle 36 or other means for forcing a stream of water, air, or water/air mixture into the water that fills the spa system. Two exemplary alcove whirlpool seats are described herein: the angled-arm seat 22 and the horseshoe seat 24.

FIGS. 2 and 3 show an exemplary embodiment of the angled-arm seat 22. The angled-arm seat 22 consists generally of a substantially horizontal seat member 30 and a seat back 32 that extends substantially upwardly from more than fifty percent (50%) of the circumference of the seat member 30. In other words, the seat back 32 wraps around a portion of the seat member 30 and leaves an open span through which a user's legs may extend when he is in a seated position. Integral with or attached to the seat back 32 is a "pair of arms" 34*a*, 34*b* which help to define the open span.

The seat member 30 may be round, oval, semi-circular, or any other shape suitable for sitting. Further, the seat member 30 may be angled slightly upward or downward to provide a suitable comfortable sitting position. Still further, the seat member 30 may be flat, contoured, padded, or otherwise designed for comfort.

The seat back 32 may be straight, angled, or convex. Like the seat member 30, the seat back 32 should be designed for comfort and therefore may be contoured or padded. An additional purpose of the seat back 32, however, is to help direct the flow of water, and therefore flow direction may play a significant part in the design of the seat back 32.

As shown in FIGS. 2 and 3, the "pair of arms" 34*a*, 34*b* may extend substantially from the floor of the spa system to substantially the top of the seat back. It should be noted that the arms 34*a*, 34*b* may not extend all the way to the floor of the spa system. The arms 34*a*, 34*b* wrap around the seat member 30. In the shown angled-arm seat 22 embodiment, a first arm 34*a* extends past the end of the seat member 30 in a substantially straight line. A second arm 34*b* in the shown angled-arm seat 22 creates an L-shape by angling inward directly after reaching the end of the seat member 30 and then extending straight out. The shape of the pair of arms 34*a*, 34*b* of the angled-arm seat 22 generally creates a substantially enclosed area of containment in which the water circulates separate and possibly different from the flow of water outside the alcove whirlpool seat.

The second arm 34*b* of the angled-arm seat 22 preferably includes at least one jet nozzle 36. The at least one jet nozzle 36 is preferably positioned to face the L-shaped bend in the second arm 34*b*. Additional jet nozzles 36 may be included to further enhance the whirlpool agitation. Further, additional jet nozzles 36 may be included so that the direction of the whirlpool flow can be changed. FIG. 3 has arrows showing the direction of an exemplary flow of water from the jet nozzles 36, against the L-shaped bend in the second arm 34*b*, spanning the seat member 30, against the first arm 34*a*, and around the seat back 32.

FIGS. 6 and 7 show an exemplary embodiment of the horseshoe seat 24. The horseshoe seat 24, like the angled-arm seat 22, consists generally of a substantially horizontal seat member 30 and a seat back 32 that extends substantially upward from more than fifty percent (50%) of the circumference of the seat member 30. In other words, the seat back 32 wraps around a portion of the seat member 30 and leaves an open span through which a user's legs may extend when he is in a seated position. Integral with or attached to the seat back 32 is a "pair of arms" 38*a*, 38*b* which help to define the open span. The first arm portion has an interior first arm surface 37*a*. The second arm portion has an interior second arm surface 37*b*. The second arm portion is substantially a mirror image to the first arm portion.

The seat member 30 may be round, oval, semi-circular, or any other shape suitable for sitting. Further, the seat member 30 may be angled slightly upward or downward to provide a suitable comfortable sitting position. Still further, the seat member 30 may be flat, contoured, padded, or otherwise designed for comfort.

The seat back 32 may be straight, angled, or convex. Like the seat member 30, the seat back 32 should be designed for comfort and therefore may be contoured or padded. An additional purpose of the seat back 32, however, is to help direct the flow of water, and therefore flow direction may play a significant part in the design of the seat back 32.

Like the angled-arm seat embodiment 22, in the horseshoe seat embodiment 24 the "pair of arms" 38*a*, 38*b* may extend substantially from the floor of the spa system to substantially the top of the seat back. It should be noted that the arms 38*a*, 38*b* may not extend all the way to the floor of the spa system. In the shown horseshoe seat 24 embodiment, the arms 38*a*, 38*b* wrap around the seat member 30 and may be substantially identical. The shape of the pair of arms 38*a*, 38*b* of the horseshoe seat 24 generally creates a substantially enclosed area of containment in which the water circulates separate and possibly different from the flow of water outside the alcove whirlpool seat.

In the horseshoe seat 24 embodiment shown in FIGS. 4, 6, and 7, each arm 38*a*, 38*b* includes at least one jet nozzle 36. The first arm surface 37*a* of the first arm 38*a* preferably includes at least one jet nozzle 36 that is preferably positioned to direct flow away from the open span of the seat member 30 and toward the seat back 32. The second arm surface 37*b* of the second arm 38*b* preferably includes at least one jet nozzle 36 that is preferably positioned to direct flow across the open span of the seat member 30. Additional jet nozzles 36 may be included to further enhance the whirlpool agitation. Further, additional jet nozzles 36 may be included so that the direction of the whirlpool flow can be changed. FIG. 6 has arrows showing the direction of the flow of water from the first set of jet nozzles 36 in the first arm 38*a* around the seat back 32 and from the second set of jet nozzles 36 in the second arm 38*b* spanning the seat member 30.

In the horseshoe seat 24 embodiment shown in FIGS. 4, 6, and 7, each arm 38*a*, 38*b* includes at least one jet nozzle 36. The first arm 38*a* preferably includes at least one jet nozzle 36 that is preferably positioned to direct flow away from the open span of the seat member 30 and toward the seat back 32. The second arm 38*b* preferably includes at least one jet nozzle 36 that is preferably positioned to direct flow across the open span of the seat member 30. Additional jet nozzles 36 may be included to further enhance the whirlpool agitation. Further, additional jet nozzles 36 may be included so that the direction of the whirlpool flow can be changed. FIG. 6 has arrows showing the direction of the flow of water from the first set of jet nozzles 36 in the first arm 38*a* around the seat back 32 and from the second set of jet nozzles 36 in the second arm 38*b* spanning the seat member 30.

FIG. 5 shows an embodiment in which the horseshoe seat 24 of FIGS. 6 and 7 is used in an alternative manner. Specifically, because the placement of the jet nozzles 36 is different, the alcove whirlpool seat spa system 20*c* has a whirlpool that is formed between a plurality of cooperative horseshoe seats 24.

In the embodiment shown in FIG. 5, a first arm 40*a* of a first horseshoe seat 24*a* includes at least one jet nozzle 36, and a first arm 40*a* of a second horseshoe seat 24*b* includes at least one jet nozzle 36. The at least one jet nozzle 36 in the first arm 40*a* of the first horseshoe seat 24*a* is preferably positioned to direct flow across the span between the first horseshoe seat 24*a* and the second horseshoe seat 24*b* and specifically toward the second arm 40*b* of the second horseshoe seat 24*b*. The at least one jet nozzle 36 in the first arm 40*a* of the second horseshoe seat 24*b* is preferably positioned to direct flow across the span between the second horseshoe seat 24*b* and the first horseshoe seat 24*a* and specifically toward the second arm 40*b* of the first horseshoe seat 24*a*. Additional jet nozzles 36 may be included to further enhance the whirlpool agitation. Further, additional jet nozzles 36 may be included so that the direction of the whirlpool flow can be changed. FIG. 5 has arrows showing the direction of the flow of water from the first set of jet nozzles 36 in the first arm 40*a* of the first horseshoe seat 24*a* across the span between the first horseshoe seat 24*a* and the second horseshoe seat 24*b* toward the second arm 40*b* of the second horseshoe seat 24*b* and from the second set of jet nozzles 36 in the first arm 40*a* of the second horseshoe seat 24*b* across the span between the second horseshoe seat 24*b* and the first horseshoe seat 24*a* and specifically toward the second arm 40*b* of the first horseshoe seat 24*a*.

It should be noted that having a whirlpool within the alcove whirlpool seat allows for persons of different sizes and shapes to achieve various soaking positions. Further, the use of the alcove whirlpool seat allows a person to change his position within the alcove whirlpool seat and still maintain the benefits of the passive therapy from the whirlpool. It should be noted that the size and/or shape of the alcove whirlpool seat may be varied. For example, custom-designed alcove whirlpool seats may be made to accommodate a person having a particular size and shape.

Alcove Whirlpool Seat Spa Systems

As set forth above, FIG. 1 shows a first preferred embodiment of an alcove whirlpool seat spa system 20*a* of the present invention in which one seat of a multiperson spa system is an alcove whirlpool seat of the present invention. FIG. 4 shows a second preferred embodiment of an alcove whirlpool seat spa system 20*b* of the present invention in which one or more whirlpool seats of a multiperson spa system is an alcove whirlpool seat of the present invention. FIG. 5 shows a third preferred embodiment of an alcove whirlpool seat spa system 20*c* of the present invention in which a whirlpool is formed between a plurality of cooperative alcove whirlpool seats of the present invention.

FIG. 1 shows a first preferred embodiment of an alcove whirlpool seat spa system 20*a* of the present invention in which one seat of a multiperson spa system is an alcove whirlpool seat of the present invention. Although the angled-arm seat 22 embodiment is specifically shown in this embodiment, the horseshoe seat 24 embodiment could also have been used. Further, although only one seat is shown as an alcove whirlpool seat, any number of seats could have been alcove whirlpool seats.

In the shown preferred embodiment of FIG. 1, the whirlpool within the angled-arm seat 22 is created by actuating a water supply, which in turn, provides a water or air/water mixture to the first jet nozzle 36 causing a stream to be ejected from the first jet nozzle 36 into the area of containment within the alcove whirlpool seat. The water supply may further actuate additional jet nozzles 36, thereby providing a water or air/water mixture to additional jet nozzles 36 causing a stream to be ejected from the additional jet nozzles 36 into the area of containment within the alcove whirlpool seat. The flow of water or air/water mixture from the additional jet nozzles 36 is optional but tends to enhance the whirlpool flow. FIGS. 1 and 3 have arrows showing the direction of an exemplary flow of water from the jet nozzles 36, against the L-shaped bend in the second arm 34*b*, spanning the seat member 30, against the first arm 34*a*, and around the seat back 32.

FIG. 4 shows a second preferred embodiment of an alcove whirlpool seat spa system 20*b* of the present invention in which one or more whirlpool seats of a multiperson spa system is an alcove whirlpool seat of the present invention. Specifically, this embodiment is a two-seater spa system. Although the horseshoe seat 24 embodiment is specifically shown in this embodiment, the angled-arm seat 22 embodiment could also have been used. Further, although only one seat is shown as an alcove whirlpool seat, both seats could have been alcove whirlpool seats.

In the shown preferred embodiment of FIG. 4, the whirlpool within the horseshoe seat 24 is created by actuating a water supply, which in turn provides a water or air/water mixture to the first set of jet nozzles 36 causing a stream to be ejected from the first set of jet nozzles 36 into the area of containment within the alcove whirlpool seat. The water supply may be further actuated, to provide water or air/water mixture to additional sets of jet nozzles 36, causing a stream to be ejected from the additional sets of jet nozzles 36 into the area of containment within the alcove whirlpool seat. The flow of water or air/water mixture from the additional sets of jet nozzles 36 is optional, but tends to enhance the whirlpool flow. FIGS. 4 and 6 have arrows showing the direction of the flow of water from the first set of jet nozzles 36 in the first arm 38*a* around the seat back 32 and from the second set of jet nozzles 36 in the second arm 38*b* spanning the seat member 30.

FIG. 5 shows a third preferred embodiment of an alcove whirlpool seat spa system 20*c* of the present invention in which a whirlpool is formed between a plurality of cooperative alcove whirlpool seats of the present invention. Although the horseshoe seat 24 embodiment is specifically shown in this embodiment, a modified angled-arm seat 22 embodiment (with additional jet nozzles 36 directed toward the opposite alcove whirlpool seat) could also have been used. Further, this embodiment could be used in conjunction with the individual alcove whirlpool seats shown in FIGS. 1 and 4. (For example, the spa could have jet nozzles so that a whirlpool is created either between two alcove whirlpool seats as shown in FIG. 5 or individually as shown in FIG. 4. Another example would be to have the seats shown as nonalcove whirlpool seats be individual alcove whirlpool seats.)

It should be noted that the number of jet nozzles 36 used in this system is highly dependent on the size of the spa system and the strength of the jet nozzles 36.

In the shown preferred embodiment of FIG. 5, the whirlpool between the horseshoe seats 24*a*, 24*b* is created by actuating a water supply to a first set of jet nozzles 36 in the first arm 40*a* of the first horseshoe seat 24*a*, which in turn provides a water or air/water mixture to the first set of jet nozzles 36, causing a stream to be ejected from the first set of jet nozzles 36. The water supply may be further actuated, thereby providing a water or air/water mixture to additional sets of jet nozzles 36 in the first arm 40*a* of the second horseshoe seat 24*b*, causing a stream to be ejected from the additional sets of jet nozzles. The flow of water or air/water mixture from the additional sets of jet nozzles 36 is optional but tends to enhance the whirlpool flow. FIG. 5 has arrows showing the direction of the flow of water from the first set of jet nozzles 36 in the first arm 40*a* of the first horseshoe seat 24*a* across the span between the first horseshoe seat 24*a* and the second horseshoe seat 24*b* toward the second arm 40*b* of the second horseshoe seat 24*b* and from the second set of jet nozzles 36 in the first arm 40*a* of the second horseshoe seat 24*b* across the span between the second horseshoe seat 24*b* and the first horseshoe seat 24*a* and specifically toward the second arm 40*b* of the first horseshoe seat 24*a*.

Jet Nozzles

Figure 8:
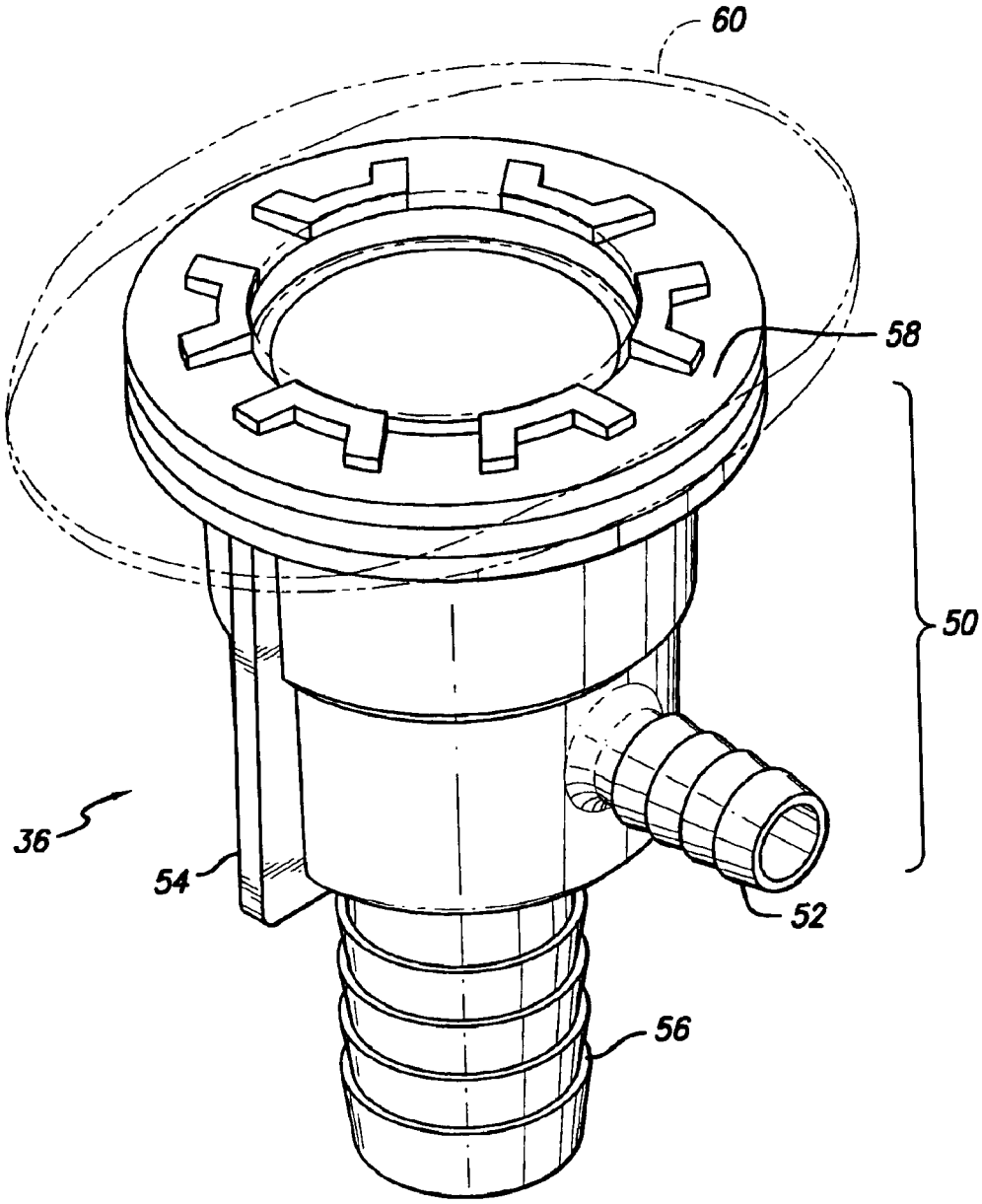
FIG. 8 is a perspective view of an exemplary jet nozzle that may be used in the present invention.

As set forth in the Background of the Invention, jet nozzles 36 are known as a means of providing streams that create the water agitation. This stream is generally created by jet nozzles 36 (or other water and/or air ejectors discussed below) or equivalent structure. Specifically, jet nozzles 36 can be used to direct a stream of either water or an air/water mixture into the body of water enclosed in the spa system. One exemplary jet nozzle 36, as shown in FIG. 8, is the jet nozzle 36 shown and described in U.S. patent application Ser. No. 29/149,139, which is assigned to the assignee of the present application and incorporated herein by reference.

The high flow jet nozzle 36 can deliver a large amount of water into the spa system using a relatively small jet nozzle 36. Conventional jet nozzles generally require bulky plumbing, using 1.5–2 inch hoses to attach a water or air hose to the back of the jet nozzle 36. Bulky plumbing increases space requirements between the molding of the spa system and the outer frame of the spa system. Increased space requirements also tend to decrease the size of the spa shell itself. The high flow jet nozzle 36 of the present invention requires only a 0.75 inch hose to be attached to the back of the jet nozzle 36. This allows for more compact fitting within the space between the shell of the spa system and the outer frame of the spa system while still providing the same amount of water as conventional jet nozzles 36.

The shown exemplary high-flow jet nozzle 36 includes a jet body 50, an air inlet port 52, optional ribs 54, a water inlet port 56, a faceplate 58, and an optional cover 60. These components may be manufactured from PVC, ABS, polycarbonate, polyethylene, polypropylene, polystyrene material, metals, plastics, or other suitable material.

The jet body 50 is preferably a substantially cylindrical body designed so that the air inlet port 52 is connected perpendicular to the jet body 50, the optional ribs 54 may provide reinforcement, the water inlet port 56 is at a first open end of the jet body, and the faceplate 58 is at the second opposite open end of the jet body.

Optionally attached to the jet body 50 is at least one support rib 54 that substantially coextends with the jet body 50. The ribs 54 provide strength and structure to the jet body 50, and during final installation of the jet nozzle 36 into the spa system, the ribs 54 prevent the jet body 50 from spinning within the spa system, thereby creating a more efficient jet nozzle 36.

Attached to or integral with the first open end of the jet body 50 is the water inlet port 56 to which a water hose may be attached. The water inlet port 56 is a hollow cylinder located at the bottom of the jet body 50 and is preferably smaller in diameter than the jet body 50. The water inlet port 56 preferably shares the same longitudinal axis as the jet body 50 so that it extends straight from the jet body 50. This straight configuration prevents water flowing through the jet nozzle 36 from having to make abrupt turns. This configuration, therefore, decreases the water turbulence that is created when water is pushed through bends and turns in a water inlet port 56. In other words, the straight configuration ultimately increases the efficiency of the jet nozzle 36.

The faceplate 58 radially extends outward from the second open end of the jet body 50. The shown faceplate 58 is composed of an upper annular lip and a lower annular lip, the lips being separated by an external circumferential groove. Preferably the external circumferential groove is located where the spa wall is inserted during installation of the jet body 50 into the spa system.

An optional escutcheon in the faceplate 58 may be provided so that an optional cover 60 may be placed on the upper lip of the faceplate 58 that will be showing within the spa system after the jet nozzle 36 has been installed.

It should be noted that streams may be created by any type of jet nozzle 36, water and/or air ejector, or equivalent stream-producing structure. It should also be noted that although the term "water" was used throughout this specification, other fluids could be used without affecting the scope of the invention. Further, although some embodiments are discussed in terms of single jet nozzles or sets of jet nozzles, the number of jet nozzles may be determined by the desired strength of the stream. It should further be noted that additional jet nozzles 36 may be added in the seat back 32 so that the alcove whirlpool seat may be used for traditional focused therapy with or without the use of the whirlpool.

Still further, additional jet nozzles 36 may be added at the end of one or more of the arms (see FIG. 2) to allow for focused therapy on the thighs, knees, ankles, or feet of a spa system user.

The terms and expressions that have been employed in the foregoing specification are used as terms of description and not of limitation and are not intended to exclude equivalents of the features shown and described or portions of them. The scope of the invention is defined and limited only by the claims that follow.

What is claimed is:

1. An alcove whirlpool seat for use in a spa system, said alcove whirlpool seat comprising:

(a) a seat member having a circumference;

(b) a seat back having arm portions on opposite sides of said seat back, said seat back extending annularly upward from a portion of said circumference of said seat member, said seat back and at least part of said arm portions substantially defining a whirlpool area;

(c) said arm portions defining an open span;

(d) at least one jet nozzle positioned to direct a stream within said whirlpool area; and (e) said at least one jet nozzle, said seat back, and said arm portions together creating a whirlpool within said whirlpool area.

2. The alcove whirlpool seat of claim 1, wherein said alcove whirlpool seat is a horseshoe seat, said horseshoe seat further comprising:

(a) a first arm portion having an interior first arm surface; and (b) a second arm portion having an interior second arm surface, said second arm portion being substantially a mirror image to said first arm portion.

3. The alcove whirlpool seat of claim 2, said horseshoe seat further comprising said at least one jet nozzle positioned in said interior first arm surface to direct said stream toward said seat back and at least one jet nozzle positioned in said interior second arm surface to direct said stream across said open span and toward said interior first arm surface.

4. The alcove whirlpool seat of claim 2, at least one jet nozzle directing said stream around said seat back and at least one jet nozzle directing said stream across said open span.

5. The alcove whirlpool seat of claim 1, wherein said alcove whirlpool seat is a horseshoe seat, said horseshoe seat further comprising:

(a) a first arm portion;

(b) a second arm portion;

(c) said second arm portion being substantially a mirror image to said first arm portion.

6. The alcove whirlpool seat of claim 1, at least one jet nozzle directing said stream around said seat back and at least one jet nozzle directing said stream across said open span.

7. An alcove whirlpool seat spa system, said spa system comprising:

(a) a spa system having an interior spa area;

(b) at least one alcove whirlpool seat within said interior spa area, each at least one alcove whirlpool seat comprising:

(i) a seat member having a circumference;

(ii) a seat back having arm portions on opposite sides of said seat back, said seat back extending annularly upward from a portion of said circumference of said seat member, said seat back and at least part of said arm portions substantially defining a whirlpool area;

(iii) said arm portions defining an open span;

(iii) at least one jet nozzle positioned to direct a stream within said whirlpool area to create a whirlpool flow; and (iv) said at least one jet nozzle, said seat back, and said arm portions together creating a whirlpool within said whirlpool area;

(c) a spa water flow within said interior spa area and outside said whirlpool area; and (d) said whirlpool flow within said whirlpool area is substantially separate from spa water flow.

8. The alcove whirlpool seat of claim 7, wherein said at least one alcove whirlpool seat is at least one horseshoe seat, each said horseshoe seat further comprising:

(a) a first arm portion having an interior first arm surface; and (b) a second arm portion having an interior second arm surface, said second arm portion being substantially a mirror image to said first arm portion.

9. The alcove whirlpool seat of claim 8, each said horseshoe seat further comprising said at least one jet nozzle positioned in said interior first arm surface to direct said stream toward said seat back and at least one jet nozzle positioned in said interior second arm surface to direct said stream across said open span and toward said interior first arm surface.

10. The alcove whirlpool seat of claim 8, at least one jet nozzle directing said stream around said seat back and at least one jet nozzle directing said stream across said open span.

11. The alcove whirlpool seat of claim 7, wherein said at least one alcove whirlpool seat is a pair of cooperative horseshoe seats, each said horseshoe seat further comprising:

(a) a first arm portion having an interior first arm surface; and (b) a second arm portion having an interior second arm surface, said second arm portion being substantially a mirror image to said first arm portion.

12. The alcove whirlpool seat of claim 11, each said horseshoe seat further comprising said at least one jet nozzle positioned in said first arm surface.

13. The alcove whirlpool seat of claim 11, at least one jet nozzle directing said stream from a first arm portion of a first cooperative horseshoe seat across a span and toward a second arm portion of a second cooperative horseshoe seat, and at least one jet nozzle directing said stream from a first arm portion of said second cooperative horseshoe seat across a span and toward a second arm portion of said first cooperative horseshoe seat.

14. The alcove whirlpool seat of claim 7, wherein said at least one alcove whirlpool seat is at least one horseshoe seat, each said horseshoe seat further comprising:

(a) a first arm portion;

(b) a second arm portion;

(c) said second arm portion being substantially a mirror image to said first arm portion.

15. The alcove whirlpool seat of claim 7, wherein said at least one alcove whirlpool seat is a pair of cooperative horseshoe seats, each said horseshoe seat further comprising:

(a) a first arm portion;

(b) a second arm portion;

(c) said second arm portion being substantially a mirror image to said first arm portion.

16. The alcove whirlpool seat of claim 7, at least one jet nozzle directing said stream around said seat back and at least one jet nozzle directing said stream across said open span.

* * * * *

UNITED STATES PATENT AND TRADEMARK OFFICE

CERTIFICATE OF CORRECTION

PATENT NO. : 6,859,954 B2
APPLICATION NO. : 10/646057
DATED : March 1, 2005
INVENTOR(S) : Collins et al.

It is certified that error appears in the above-identified patent and that said Letters Patent is hereby corrected as shown below:

Column 5,
Lines 30-45, should be deleted.

Column 9,
Line 21, (Claim 1(d)), after "positioned" insert -- in said whirlpool area --.

Column 9,
Line 24, (Claim 1(e)), delete "whirlpool", insert -- rotating current of water --.

Column 9,
Line 68, (Claim 7(b)), "(iii)" should read -- (iv) --.

Column 9,
Line 68, (Claim 7(b)), after "positioned" insert -- in said whirlpool area --.

Column 9,
Line 69, (Claim 7(b)), delete the first occurrence of "whirlpool", insert -- rotating current of water --.

Column 10,
Line 1, (Claim 7(b)), "(iv)" should read -- (v) --.

Column 10,
Line 66, please insert claims 17-20 as follows:

17. An alcove whirlpool seat for use in a spa system, said alcove whirlpool seat comprising:

(a) a seat member having a circumference;
(b) a seat back having arm portions on opposite sides of said seat back, said seat back extending annularly upward from a portion of said circumference of said seat member, said seat back and at least part of said arm portions substantially defining a whirlpool area;
(c) said arm portions defining an open span;
(d) at least one jet nozzle positioned to direct a stream within said whirlpool area; and
(e) said at least one jet nozzle, said seat back, and said arm portions together creating a whirlpool of water rotating in a substantially circular or oval fashion within said whirlpool area.

UNITED STATES PATENT AND TRADEMARK OFFICE

CERTIFICATE OF CORRECTION

PATENT NO. : 6,859,954 B2
APPLICATION NO. : 10/646057
DATED : March 1, 2005
INVENTOR(S) : Collins et al.

It is certified that error appears in the above-identified patent and that said Letters Patent is hereby corrected as shown below:

Column 10,
Line 66, (continued)

18. The alcove whirlpool seat of claim 17, wherein said at least one alcove whirlpool seat is a pair of cooperative horseshoe seats, each said horseshoe seat further comprising:

(a) a first arm portion;
(b) a second arm portion;
(c) said second arm portion being substantially a mirror image to said first arm portion.

19. The alcove whirlpool seat of claim 18, said horseshoe seat further comprising said at least one jet nozzle positioned in said interior first arm surface to direct said stream toward said seat back and at least one jet nozzle positioned in said interior second arm surface to direct said stream across said open span and toward said interior first arm surface.

20. The alcove whirlpool seat of claim 17, at least one jet nozzle directing said stream around said seat back and at least one jet nozzle directing said stream across said open span.

Signed and Sealed this

Sixteenth Day of October, 2007

JON W. DUDAS
*Director of the United States Patent and Trademark Office*